US010831144B2

(12) United States Patent
Shibata

(10) Patent No.: US 10,831,144 B2
(45) Date of Patent: Nov. 10, 2020

(54) IMAGE FORMING APPARATUS

(71) Applicant: CANON KABUSHIKI KAISHA, Tokyo (JP)

(72) Inventor: Kota Shibata, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/675,560

(22) Filed: Nov. 6, 2019

(65) Prior Publication Data

US 2020/0166883 A1 May 28, 2020

(30) Foreign Application Priority Data

Nov. 27, 2018 (JP) ..... 2018-221695

(51) Int. Cl.
*G03G 15/00* (2006.01)

(52) U.S. Cl.
CPC ..... *G03G 15/6564* (2013.01); *G03G 15/5008* (2013.01); *G03G 15/6558* (2013.01); *G03G 15/5029* (2013.01); *G03G 15/6555* (2013.01); *G03G 15/6588* (2013.01); *G03G 15/6591* (2013.01); *G03G 15/6594* (2013.01); *G03G 2215/00409* (2013.01); *G03G 2215/00599* (2013.01); *G03G 2215/00632* (2013.01); *G03G 2215/00721* (2013.01)

(58) Field of Classification Search
CPC ..... G03G 15/5008; G03G 15/5029; G03G 15/6555; G03G 15/6558; G03G 15/6564; G03G 15/6588; G03G 15/6591; G03G 15/6594; G03G 2215/00409; G03G 2215/00599; G03G 2215/00632; G03G 2215/00721
See application file for complete search history.

(56) References Cited

U.S. PATENT DOCUMENTS

2007/0196115 A1* 8/2007 Soutome ..... G03G 15/6564 399/16
2012/0275802 A1* 11/2012 Tomita ..... G03G 15/6561 399/38
2017/0315480 A1* 11/2017 Momiyama ..... G03G 15/2028

FOREIGN PATENT DOCUMENTS

JP 2003-280485 A 10/2003

* cited by examiner

*Primary Examiner* — Joseph S Wong
(74) *Attorney, Agent, or Firm* — Venable LLP

(57) ABSTRACT

An image forming apparatus includes an image bearing member, a transfer portion configured to transfer an image borne on the image bearing member to a sheet, a current detection portion configured to detect a current flowing through the transfer portion, a conveyance portion configured to convey the sheet to the transfer portion, a driving portion configured to drive the conveyance portion, and a controller configured to acquire an arrival timing at which a leading edge of a preceding sheet has arrived at the transfer portion based on a detection result of the current detection portion, and control the driving portion in response to the arrival timing in a state where a succeeding sheet that follows the preceding sheet is conveyed by the conveyance portion.

9 Claims, 10 Drawing Sheets

FIG.7

| DIFFERENCE ΔS FROM NOMINAL ARRIVAL TIMING | SHEET POSITION WITH RESPECT TO TONER IMAGE |
|---|---|
| $\Delta S > 0$ | DELAYED |
| $\Delta S < 0$ | EARLY |
| $\Delta S = 0$ | NOT DEVIATED |

IF SHEET ARRIVAL IS DELAYED

IF SHEET ARRIVAL IS EARLY

IMAGE FORMING APPARATUS

BACKGROUND OF THE INVENTION

Field of the Invention

The present invention relates to an image forming apparatus for forming an image on a sheet.

Description of the Related Art

Generally, an image forming apparatus such as a printer adopting an electrophotographic system forms a toner image on a photosensitive drum and conveys a sheet by a registration roller pair at a matched timing with a transfer timing of the toner image. Heat and pressure are applied at a fixing unit to the sheet to which image has been transferred from the photosensitive drum, and thereafter, the sheet is discharged onto a sheet discharge tray.

A leading edge position of the sheet temporarily stopped at a nip portion of the registration roller pair may be varied depending on a thickness of the sheet, so that there was a drawback that the position of the image transferred to the sheet was deviated due to this variation of the leading edge position. Therefore, a printer has been proposed in which a timing to write image is varied depending on a thickness of the sheet so as to transfer the image to an appropriate position of the sheet (refer to Japanese Patent Application Laid-Open Publication No. 2003-280485).

However, according to the printer disclosed in Japanese Patent Application Laid-Open Publication No. 2003-280485, if an external dimension of the registration roller pair is changed and conveyance speed of the sheet by the registration roller pair is not set to a desired speed, the sheet may be deviated from the position of the image being transferred. For example, the external dimension of the registration roller pair may be varied if the registration roller pair is worn by friction with sheets or if the registration roller pair experiences heat expansion due to change of ambient pressure.

SUMMARY OF THE INVENTION

According to a first aspect of the present invention, an image forming apparatus includes an image bearing member, a transfer portion configured to transfer an image borne on the image bearing member to a sheet, a current detection portion configured to detect a current flowing through the transfer portion, a conveyance portion configured to convey the sheet to the transfer portion, a driving portion configured to drive the conveyance portion, and a controller configured to acquire an arrival timing at which a leading edge of a preceding sheet has arrived at the transfer portion based on a detection result of the current detection portion, and control the driving portion in response to the arrival timing in a state where a succeeding sheet that follows the preceding sheet is conveyed by the conveyance portion.

According to a second aspect of the present invention, an image forming apparatus includes an image bearing member, a transfer portion configured to transfer an image borne on the image bearing member to a sheet, a current detection portion configured to detect a current flowing through the transfer portion, a conveyance portion configured to convey the sheet to the transfer portion, and a controller configured to acquire an arrival timing at which a leading edge of a preceding sheet has arrived at the transfer portion based on a detection result of the current detection portion, and control an image forming timing of the image forming portion to the image bearing member and a transfer timing at which the transfer portion transfers the image to a succeeding sheet in response to the arrival timing when the succeeding sheet that follows the preceding sheet is conveyed by the conveyance portion.

Further features of the present invention will become apparent from the following description of exemplary embodiments with reference to the attached drawings.

BRIEF DESCRIPTION OF THE DRAWINGS

FIG. 7 is a table illustrating a relationship between arrival timing of the sheet to the transfer nip and a state of the sheet.

DESCRIPTION OF THE EMBODIMENTS

First Embodiment

Figure 1:
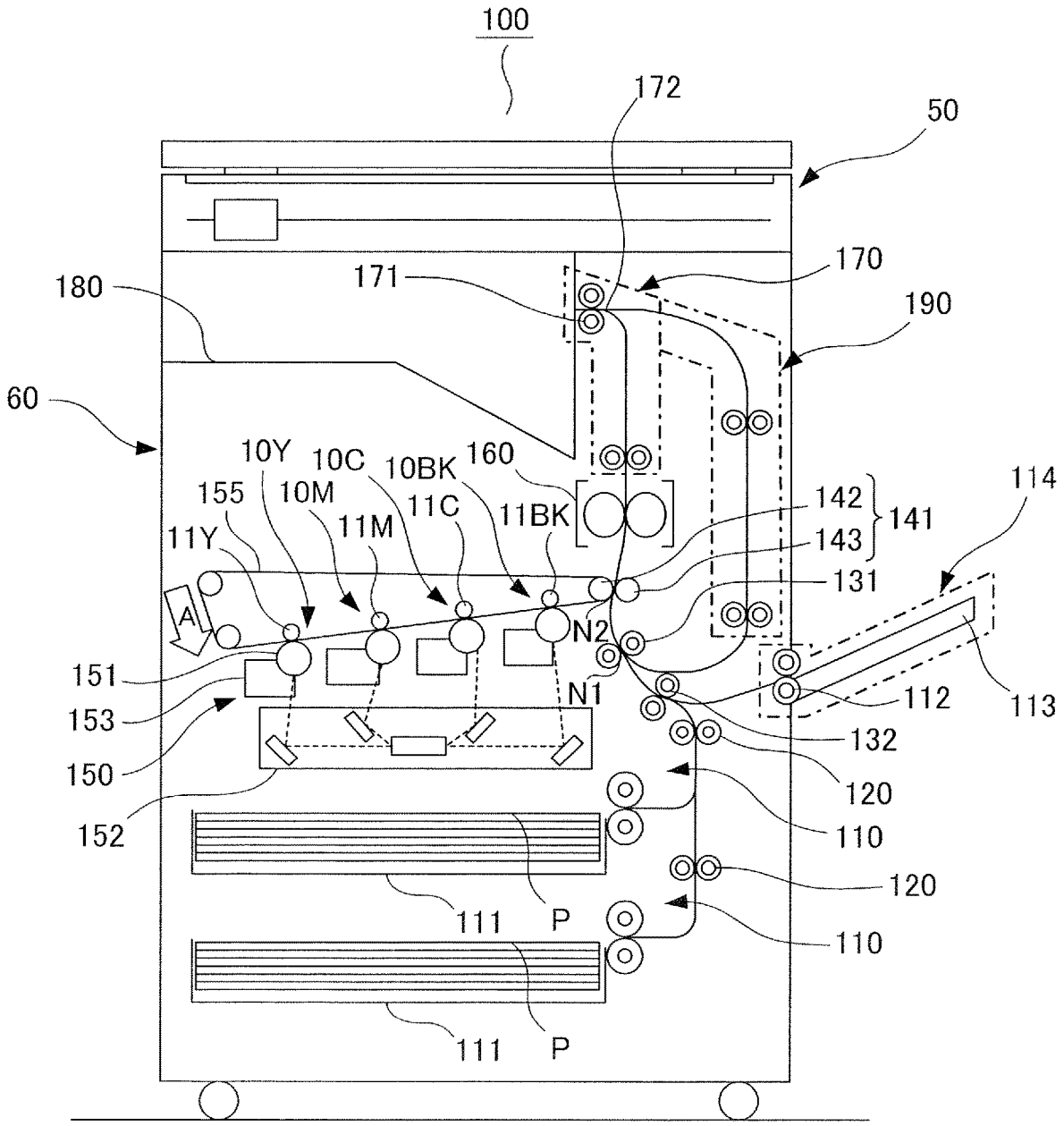
FIG. 1 is an entire schematic diagram illustrating a printer illustrating a printer according to a first embodiment.

A printer 100 serving as an image forming apparatus according to a first embodiment is a full-color laser beam printer adopting an electrophotographic system. The printer 100 includes, as illustrated in FIG. 1, an image reading apparatus 50 for reading an image on a document, and a printer main body 60. The printer main body 60 includes a sheet feed portion 110 serving as a sheet conveyance apparatus that feeds sheets being supported thereon, an image forming portion 150 for forming an image on a sheet, a fixing portion 160 for fixing a toner image on a sheet, a sheet discharge conveyance portion 170, and a duplex printing conveyance portion 190. If a command to form an image is entered to the printer 100, an image forming process by the image forming portion 150 is started based on an image information entered from the image reading apparatus 50 or from an external computer and the like connected to the printer 100.

The image forming portion 150 adopts a four-drum full-color system. The image forming portion 150 includes a laser scanner 152, and four process cartridges 10Y, 10M, 10C and 10BK for forming toner images of four colors, which are yellow (Y), magenta (M), cyan (C) and black (BK).

The four process cartridges 10Y, 10M, 10C and 10BK adopt the same configuration, except for the difference in the colors of the images being formed. Therefore, only the configuration and image forming process of the process cartridge 10Y will be described, and descriptions of the process cartridges 10M, 10C and 10BK will be omitted.

The process cartridge 10Y includes a photosensitive drum 151, a charging unit not shown, and a developing unit 153. The laser scanner 152 serving as an image forming portion irradiates laser beam toward the photosensitive drum 151 based on the image information being entered. In this state, the photosensitive drum 151 is charged in advance by the charging unit, and an electrostatic latent image is formed on the photosensitive drum 151 by having laser beam irradiated thereon. Thereafter, the electrostatic latent image is developed by the developing unit 153, and a toner image is formed on the photosensitive drum 151.

An intermediate transfer belt 155 serving as an image bearing member is arranged above the process cartridges 10Y, 10M, 10C and 10BK, and the intermediate transfer belt 155 is driven to rotate in an arrow A direction by a transfer drive roller 142. Four primary transfer rollers 11Y, 11M, 11C and 11BK that abut against an inner surface of the intermediate transfer belt 155 at positions opposing to the respective photosensitive drums 151 are arranged on an inner side of the intermediate transfer belt 155. Further, a transfer driven roller 143 that abuts against an outer surface of the intermediate transfer belt 155 is arranged at a position opposed to the transfer drive roller 142. The transfer drive roller 142 and the transfer driven roller 143 constitute a transfer roller pair 141, and abut against one another to form a transfer nip N2.

In the image forming process, a yellow (Y) toner image formed on the photosensitive drum 151 is transferred to and borne on the intermediate transfer belt 155 by having an electrostatic bias applied to a primary transfer roller 11Y. Similarly, toner images of respective colors are transferred from the primary transfer rollers 11M, 11C and 11BK to the intermediate transfer belt 155 so as to be superposed to the toner image already primarily transferred at an upstream position. Thereby, a full-color toner image is formed on the intermediate transfer belt 155. The full-color toner image is conveyed to the transfer nip N2 by the intermediate transfer belt 155 rotated by the transfer drive roller 142.

In parallel with the above-described image forming process, a sheet P is conveyed from the sheet feed portion 110. The sheets P stacked in a plurality of cassettes 111, the number of which according to the present embodiment is two, are separated and fed by the sheet feed portion 110 one sheet at a time by a pickup roller and a separation roller pair, and the cassettes can be drawn out from the printer main body 60 toward a front direction. The sheet P fed from the sheet feed portion 110 is conveyed by a drawing roller pair 120 and a pre-registration roller pair 132 to a registration roller pair 131.

Further, a manual sheet feed portion 114 including a manual sheet feed tray 113 capable of supporting sheets is provided on the printer main body 60. The sheets supported on the manual sheet feed tray 113 are separated one by one by a manual sheet feed conveyance portion 112, and thereafter, conveyed to the pre-registration roller pair 132.

The pre-registration roller pair 132 presses a leading edge of a sheet P against a nip N1 of a registration roller pair 131 serving as a conveyance portion in a non-rotating state, and a loop is formed on the sheet P. Thereby, the leading edge of the sheet P is aligned with the nip N1 of the registration roller pair 131 and skewing of the sheet P is corrected. The sheet P subjected to skew correction is conveyed by the registration roller pair 131 at a matched timing with transfer by the transfer nip N2 serving as a transfer portion, and in a state where a predetermined transfer current is flown to the transfer roller pair 141, the toner image on the intermediate transfer belt 155 is transferred. The sheet P onto which the toner image has been transferred is subjected to predetermined heat and pressure at the fixing portion 160, by which the toner is melted and fixed. The sheet P passing through the fixing portion 160 is discharged by the sheet discharge conveyance portion 170 including a sheet discharge roller pair 171 onto a sheet discharge tray 180.

If images are to be formed on both sides of the sheet P, the sheet discharge roller pair 171 rotates in a normal direction to send a leading edge side of the sheet P on which the toner image has been formed on a first side to an outer side of the device, and after a trailing edge of the sheet P passes a turning point 172, the rotation is reversed. Thereby, the sheet P is subjected to switch-back, and the sheet is conveyed to the duplex printing conveyance portion 190 in a state where the front and rear sides of the sheet are inverted. Then, the sheet P is conveyed again to the transfer nip N2 by the duplex printing conveyance portion 190, and a toner image is formed on a second side of the sheet P. The sheet P on which toner images are transferred to the first side and the second side passes through a path described above and is discharged to the sheet discharge tray 180.

Application of Transfer Current to Transfer Roller Pair

Figure 2:
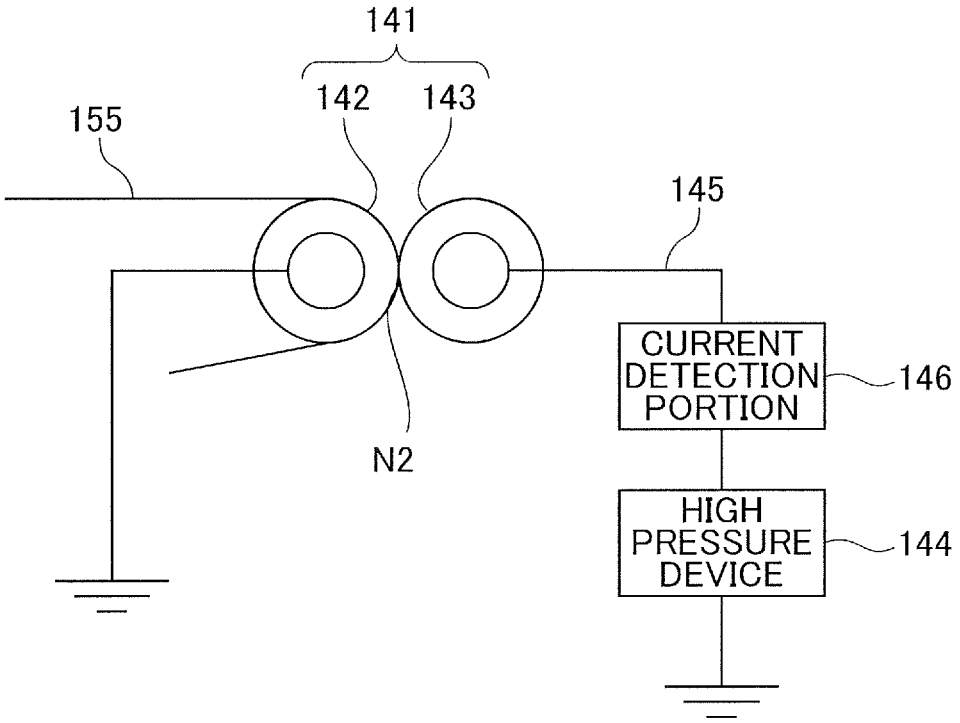
FIG. 2 is a schematic view illustrating a configuration for applying a transfer current to a transfer roller pair.

Next, a configuration for applying transfer current to the transfer roller pair 141 will be described. As illustrated in FIG. 2, the transfer driven roller 143 configuring the transfer roller pair 141 is urged toward the transfer drive roller 142 by an urging portion not shown. Transfer current is flown to the transfer roller pair 141 through a high pressure path 145 from the high pressure device 144. In a state where the transfer current is flown to the transfer roller pair 141, an electrostatic load bias is generated, and the toner image on the intermediate transfer belt 155 is transferred to the sheet P.

The transfer current required to transfer the toner image differs depending on grammage and amount of moisture of the sheet P, and if the transfer current is small, sufficient electrostatic attaching force is not applied on the toner, and image defects such as transfer failure occurs. A current detection portion 146 is provided on the high pressure path 145, and the transfer current flowing through the transfer roller pair 141 is detected by the current detection portion 146. Output voltage of the high pressure device 144 is controlled so that a current value flowing to the high pressure path 145 becomes a predetermined current value based on the detection result of the current detection portion 146.

Control Block

Figure 3:
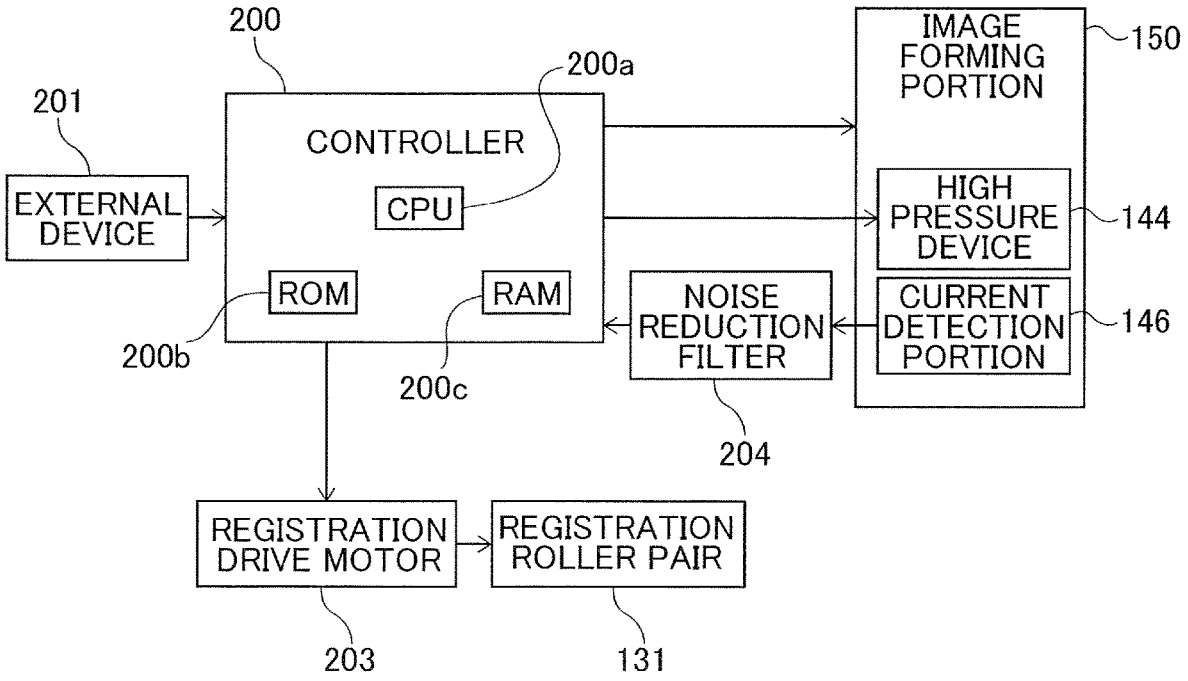
FIG. 3 is a control block diagram according to the first embodiment.

FIG. 3 is a control block diagram according to the printer 100 of the present embodiment. A controller 200 of the printer 100 includes a CPU 200*a*, a ROM 200*b*, a RAM 200*c* and the like not shown, and executes programs for controlling various apparatuses in the printer 100. External devices 201 such as an external PC, an operation panel and so on are connected to the controller 200, and image signals and information related to the attribute of the sheet conveyed by the printer 100 are entered from the external device 201.

A registration drive motor 203 serving as a driving portion for driving the image forming portion 150 and the registration roller pair 131 are connected to the controller 200. The registration drive motor 203 adjusts a feed start timing of the sheet P by the registration roller pair 131 so that the toner image on the intermediate transfer belt 155 is transferred to a desired position on the sheet P. The feed start timing is a timing at which the registration roller pair 131 being in a non-rotating state is started to be driven to correct skewing of the sheet P. The current detection portion 146 is connected to the controller 200 via a noise reduction filter 204, and the controller 200 controls the output of the high pressure device 144 and adjusts the transfer current in response to the value of the current detection portion 146.

Method for Detecting Arrival of Sheet to Transfer Nip

Figure 4A:
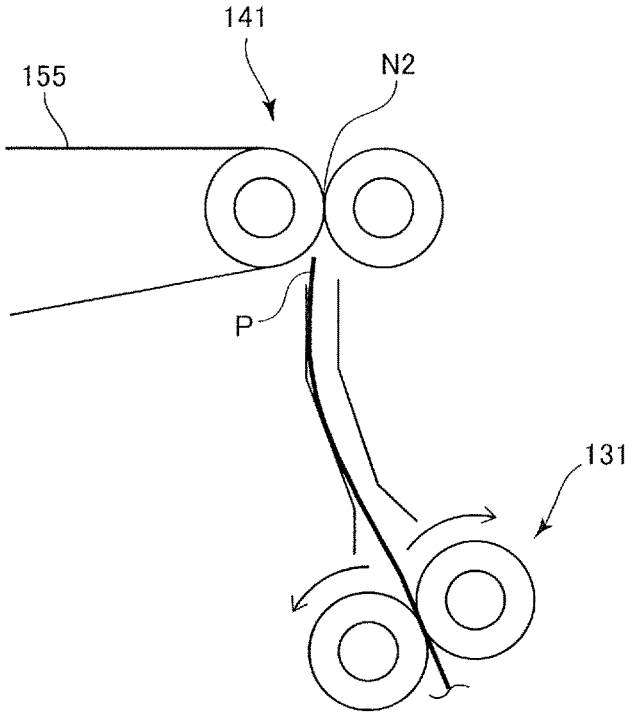
FIG. 4A is a view illustrating a state immediately before a leading edge of a sheet reaches a transfer nip.
Figure 5:
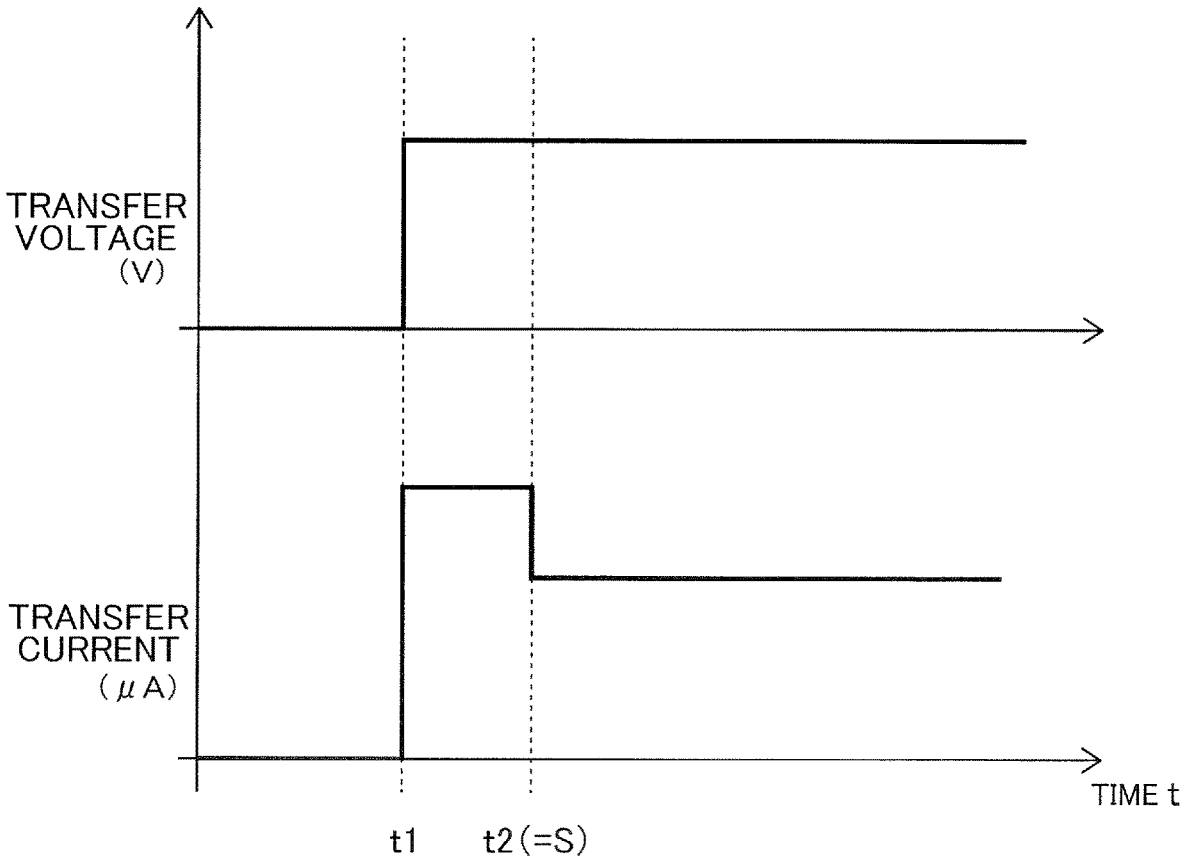
FIG. 5 is a graph illustrating a transfer voltage and a transfer current of the transfer roller pair.

Next, a method for detecting that the sheet P has reached the transfer nip N2 according to the present embodiment will be described. FIG. 4A is a view illustrating a state immediately prior to the leading edge of the sheet P reaching the transfer nip N2 of the transfer roller pair 141. If this time is referred to as time t1, as illustrated in FIGS. 2 and 5, application of transfer voltage to the transfer roller pair 141 by the high pressure device 144 is started at time t1.

Thereby, transfer current flows to the transfer roller pair 141, and current value of the transfer current is detected by the current detection portion 146. If the current value flowing to the high pressure path 145 and the transfer roller pair 141 in this state is referred to as $I_1$, the current value $I_1$ is determined by the following expression based on a voltage value V applied from the high pressure device 144 and an electric resistance R of the member constituting the high pressure path 145.

$$I_1=V/R$$

Figure 4B:
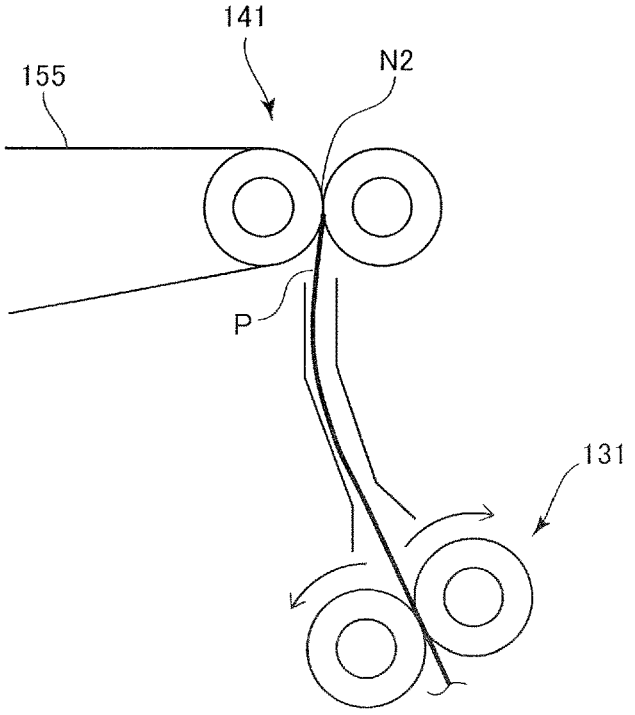
FIG. 4B is a view illustrating a state after the leading edge of the sheet has arrived at the transfer nip.

FIG. 4B is a view illustrating a state where the leading edge of the sheet P has reached the transfer nip N2. If this time is referred to as time t2, electric resistance of the high pressure path 145 is added corresponding to the amount of electric resistance Rp of the sheet P, so that a current value $I_2$ at time t2 is determined by the following expression.

$$I_2=V/(R+Rp)$$

As $Rp>0$, $I_2<I_1$ is obtained.

As described, in a state where the sheet P enters the transfer nip N2, the current value flowing to the high pressure path 145 and the transfer roller pair 141 is reduced. In the present embodiment, the current detection portion 146 detects the reduction of current value, in response to which the arrival timing of the sheet P to the transfer nip N2 can be detected.

Feed Start Timing Determination Control

Next, a feed start timing determination control for determining the feed start timing of the sheet P by the registration roller pair 131 will be described with reference to the flowchart of FIG. 6. The feed start timing is a timing at which the registration roller pair 131 starts to feed the sheet P abutted against the nip N1.

Figure 6:
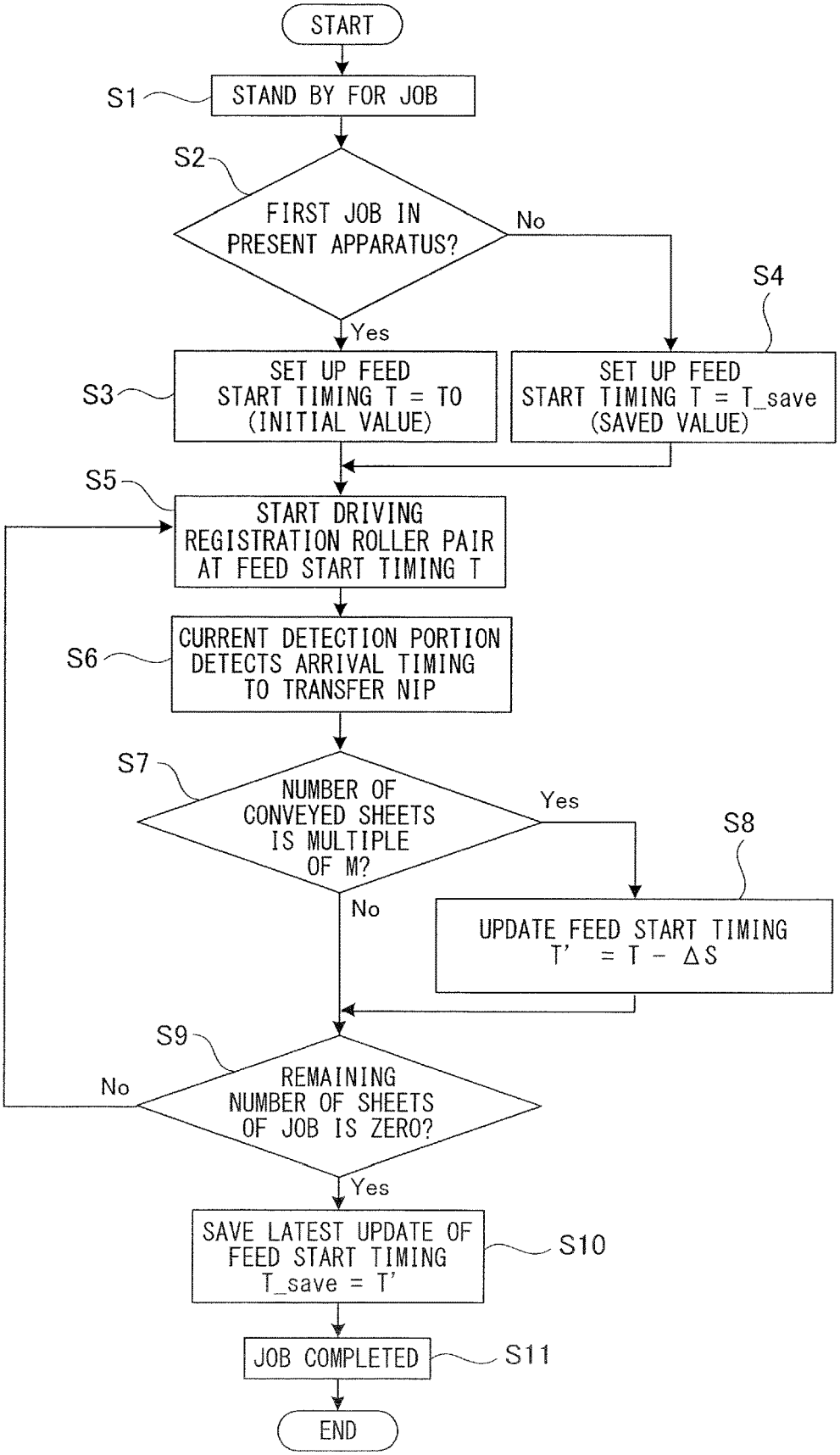
FIG. 6 is a flowchart illustrating a feed start timing determination control.

As illustrated in FIG. 6, at first, the controller 200 stands by for a job for forming an image to be entered, for example (step S1). If a job is entered for the first time in the printer 100 (step S2: Yes), the controller 200 sets a feed start timing T by the registration roller pair 131 to T0 as an initial value (step S3). The initial value T0 is a timing calculated so that a toner image is transferred to an appropriate position at the transfer nip N2 in a state where a sheet of a type generally most frequently used, such as normal paper having a grammage of 60 [gsm], is conveyed by the new registration roller pair 131. The new registration roller pair 131 has a registration roller diameter of an initial dimension determined by standard.

Next, the controller 200 starts to drive the registration roller pair 131 at the feed start timing T, and thereafter, the current detection portion 146 detects an arrival timing S of the sheet P to the transfer nip N2 based on a reduction of the transfer current, as described above (steps S5, S6). The arrival timing S corresponds to time t2 in FIG. 5. A starting point, i.e., reference, for measuring the arrival timing S is a timing at which the sheet is started to be fed by the registration roller pair 131, for example. That is, the arrival timing S can also be converted to a time from which the sheet P is started to be fed by the registration roller pair 131 to when the leading edge of the sheet P reaches the transfer nip N2. Further, the starting point for measuring the arrival timing S can be set to any of the following timings: a timing for starting image forming process of image formed on the sheet; a feed start timing of the sheet by the pickup roller; and a timing at which the leading edge of the sheet has passed a predetermined position upstream of the transfer nip N2 on the conveyance path in the sheet conveyance direction.

Next, the controller 200 determines whether a number of conveyed sheets conveyed by the registration roller pair 131 has reached a multiple of M (step S7). The current detection portion 146 detects the arrival timing S of each sheet P. In a state where the number of conveyed sheets has reached a multiple of M, which is a multiple number such as M=10 (step S7: Yes), the controller 200 updates the feed start timing T as in the following expression (step S8).

$$T'=T-\Delta S$$

That is, by subtracting value ΔS from the current feed start timing T, a new feed start timing T' is obtained. Value ΔS is a value in which a nominal arrival timing (S0), that is, theoretical arrival timing not affected by wear of the registration roller pair 131, is subtracted from an average value of arrival timing of the M number of sheets P. In other words, value ΔS is a deviation from the nominal arrival timing. By subtracting the calculated value ΔS from the feed start timing T, a new feed start timing T' capable of transferring the toner image to an appropriate position on a succeeding sheet is obtained. If the feed start timing is updated, the controller 200 drives the registration drive motor 203 in response to a new feed start timing T'. In the case of M=1, the value ΔS is updated every time a sheet is conveyed.

FIG. 7 is a correspondence table of delayed arrival or early arrival of the sheet P with respect to positive and negative values of ΔS. If $\Delta S>0$, the arrival timing of the sheet P to the transfer nip N2 is delayed than the nominal arrival timing, so delayed arrival is determined. Further, if $\Delta S<0$, the arrival timing of the sheet P to the transfer nip N2 is earlier than the nominal arrival timing, so early arrival is determined. Meanwhile, if $\Delta S=0$, it means that the arrival timing of the sheet P is equal to the nominal arrival timing.

As illustrated in FIG. 6, if the number of conveyed sheets in step S7 is not a multiple of M (step S7: No), and if the process of step S8 is performed, the controller 200 determines whether the number of remaining sheets conveyed during the present job has reached zero (step S9). If the remaining number of sheets is not zero (step S9: No), the procedure returns to step S5. For example, if the job being entered is a job to form an image on 30 sheets, steps S5 to S9 are performed for three times. Each time ten sheets P are conveyed, the feed start timing T is updated.

If the number of remaining sheets has reached zero (step S9: Yes), the controller 200 saves the latest feed start timing T' as a feed start timing T_save for a succeeding job in a ROM 200*b* in the controller 200 (step S10). As described, the job and the feed start timing determination control are completed (step S11). In a state where a second or subsequent job is entered to the printer 100 in step S2 (step S2: No), the feed start timing T is set to T_save which is a saved value (step S4), and the procedure advances to step S5. That is, the ROM 200*b*, serving as a storage portion, in the controller 200 stores the feed start timing which has been changed at the end of the first job, and in the second job that follows the first job, the controller 200 feeds the first sheet of the second job at a feed start timing stored in the ROM 200*b*.

Figure 8A:
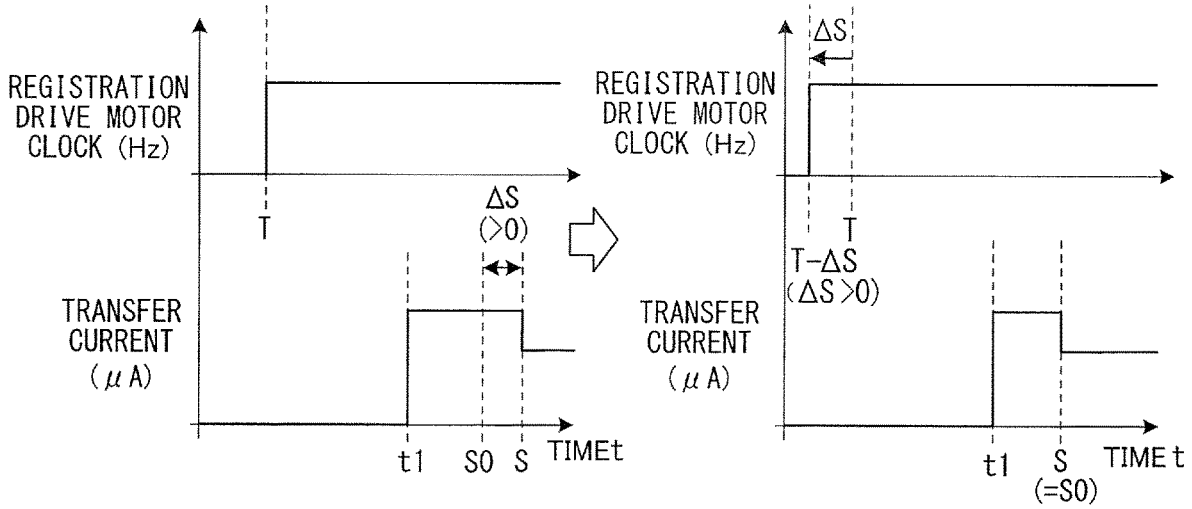
FIG. 8A is a view illustrating a relationship between change of rotational frequency of registration drive motor and transfer current in a state where arrival of the sheet is delayed.
Figure 8B:
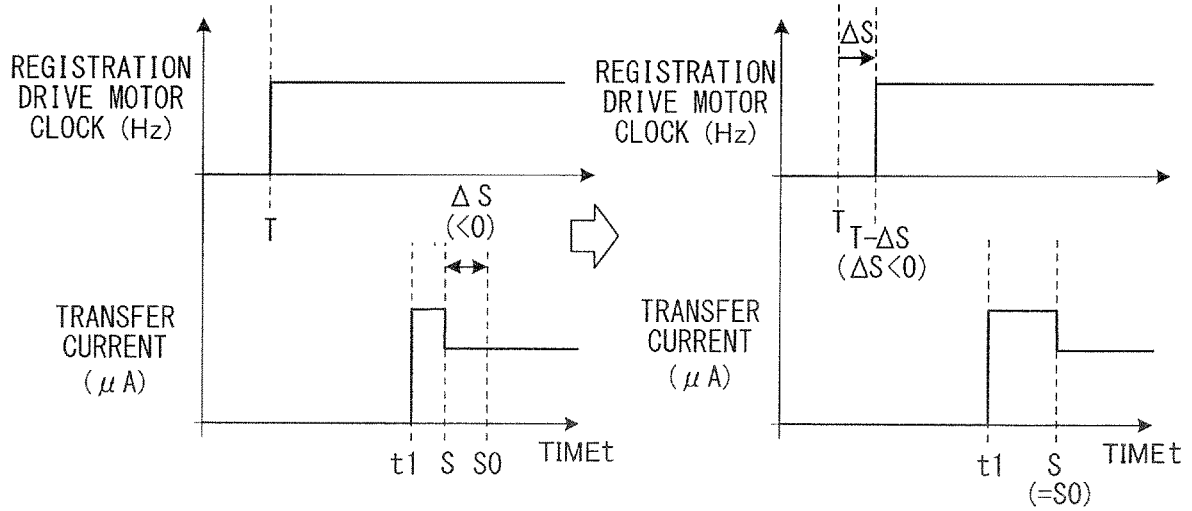
FIG. 8B is a view illustrating a relationship between change of rotational frequency of registration drive motor and transfer current in a state where arrival of the sheet is early.

FIG. 8 is a view illustrating a relationship between change of rotational frequency of the registration drive motor 203 and the transfer current before and after update of the feed start timing T of the registration roller pair 131, wherein FIG. 8A illustrates a state where arrival of the sheet is delayed, and FIG. 8B illustrates a state where arrival of the sheet is early. As illustrated in FIG. 8A, in a state where the arrival of the sheet P to the transfer nip N2 is delayed, the arrival timing S is delayed than the nominal arrival timing S0. Therefore, in step S8, a value ΔS (>0) which is the difference between the nominal arrival timing S0 and the arrival timing S of the registration drive motor 203 is subtracted from the feed start timing T.

Now, the nominal arrival timing S0 is set as a first arrival timing, and the drive start timing of the registration drive motor 203 for conveying a succeeding sheet in a case where the arrival timing of the preceding sheet was the nominal arrival timing S0 is set as a first feed start timing. Then, if the arrival timing S of the preceding sheet is a second arrival timing that is delayed than the first arrival timing, the drive start timing of the registration drive motor 203 for conveying the succeeding sheet is a second drive start timing that is earlier than the first drive start timing.

As illustrated in FIG. 8B, if the sheet P has arrived early at the transfer nip N2, the arrival timing S is set earlier than the nominal arrival timing S0. Therefore, in step S8, value ΔS (<0) which is the difference between the nominal arrival timing S0 and the arrival timing S is subtracted from the feed start timing T of the registration drive motor 203. That is, the absolute value of ΔS is added to the feed start timing T. In other words, if the arrival timing S of the preceding sheet is a third arrival timing that is earlier than the first arrival timing, the drive start timing of the registration drive motor 203 for conveying the succeeding sheet is a third drive start timing that is delayed than the first drive start timing.

Then, the controller 200 performs control so that the registration drive motor 203 is driven to be started at a new feed start timing T' for the succeeding sheet P, in response to which the arrival timing S of the succeeding sheet P is set equal to the nominal arrival timing S0.

As described, according to the present embodiment, the arrival timing of the preceding sheet to the transfer nip N2 is obtained based on the detection result of the current detection portion 146, and in a state where the succeeding sheet is conveyed by the registration roller pair 131, the registration drive motor 203 is controlled in response to the arrival timing being acquired. Actually, the difference between the acquired arrival timing and the nominal arrival timing is subjected to feed back to the feed start timing of the succeeding sheet by the registration roller pair 131. Therefore, even if the peripheral speed of the registration roller pair 131 is varied by wear or heat expansion of the registration roller pair 131, the toner image can be transferred to an appropriate position on the sheet P while suppressing image deviation, and a product having a high quality can be obtained.

Further, since image deviation can be suppressed even if the registration roller pair 131 is worn, there is no need to realize a high level of intensity and machining accuracy of the registration roller pair 131, and costs can be cut down. Further, since the arrival timing of the sheet P to the transfer nip N2 can be detected without providing a sensor for detecting the leading edge position of the sheet between the registration roller pair 131 and the transfer roller pair 141, the sensor can be omitted. Therefore, the space between the registration roller pair 131 and the transfer nip N2 can be saved, and costs can be cut down.

Second Embodiment

Next, a second embodiment of the present invention will be described. The second embodiment adopts a configuration where a feed start timing determination control is different from the first embodiment. Therefore, configurations that are similar to the first embodiment are either not shown in the drawing or denoted with the same reference numbers.

A conveyance path leading from the registration roller pair 131 to the transfer nip N2 is formed to have a narrow gap between opposing guides and the conveyance path is bent, so that play of the sheet P is suppressed and that the sheet is conveyed stably. If the sheet P is conveyed along such conveyance path, the sheet P is rubbed against the conveyance guide and frictional resistance occurs. Especially if a thick paper having a relatively high stiffness is conveyed, frictional resistance is increased, so that the sheet P may slip at the nip N1 of the registration roller pair 131 and conveyance speed may be decreased. A slip ratio at this time depends on a frictional coefficient between the sheet P and the roller, which is also affected by the smoothness of the sheet, so that the conveyance speed of the sheet P is varied greatly by the attribute of the sheet.

Therefore, based on the control for updating the feed start timing uniformly without depending on the sheet attribute as according to the first embodiment, the arrival timing of the sheet P to the transfer roller pair 141 will be deviated if the sheet type is changed.

Figure 9:
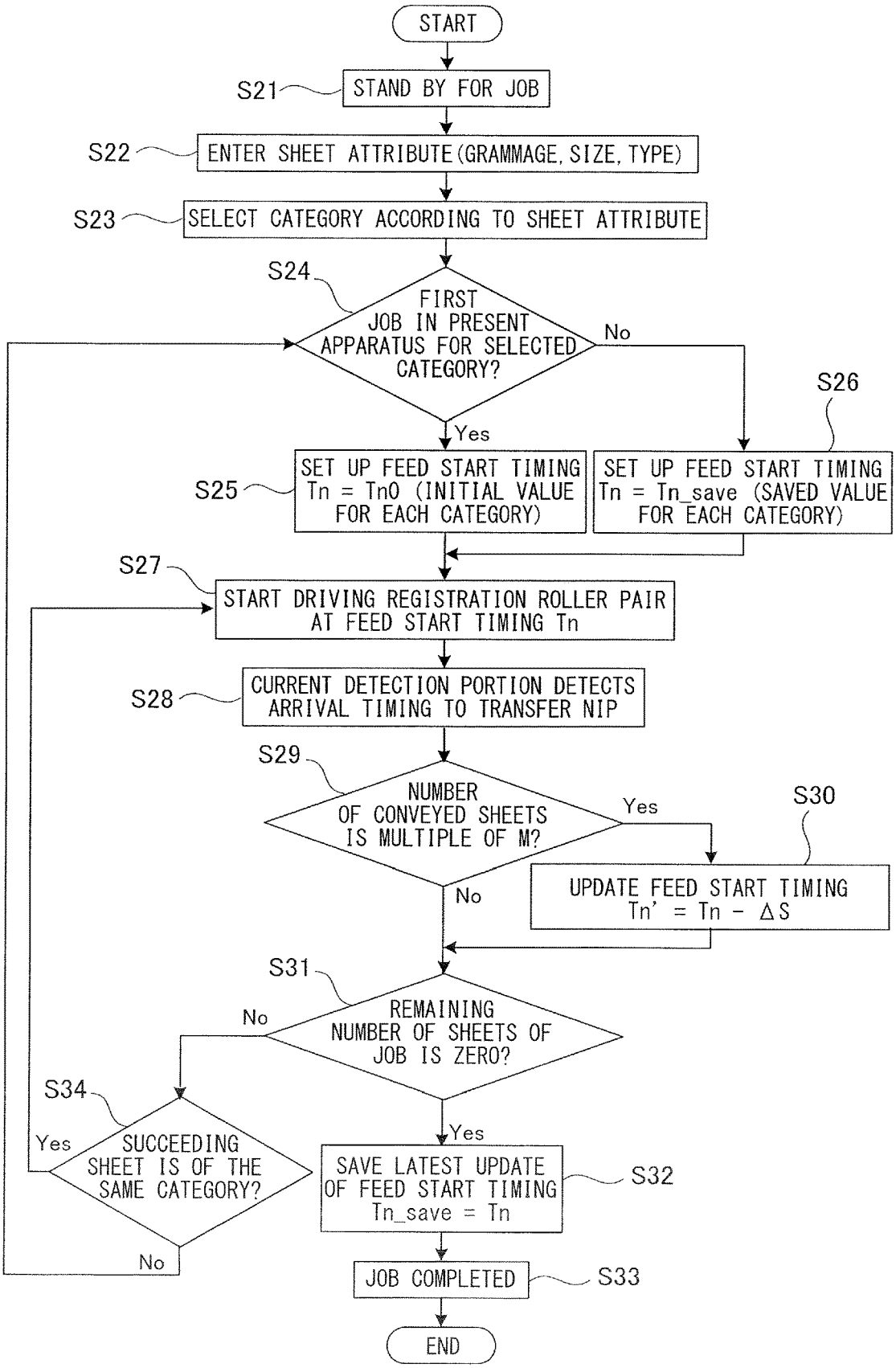
FIG. 9 is a flowchart illustrating a feed start timing determination control according to a second embodiment.

Therefore, the feed start timing determination control according to the present embodiment will be described with reference to the flowchart of FIG. 9. As illustrated in FIG. 9, at first, the controller 200 stands by for entry of an image forming job (step S21). Next, information related to attribute of the sheet is entered to the controller 200 through the external device 201 (step S22). The attribute of the sheet includes grammage, size and type. Grammage is a physical property representing density of the sheet, and it is correlated generally with the stiffness of the sheet.

The attribute of the sheet is categorized in advance, and the feed start timing T as initial value is set per category. The controller 200 selects a category according to the attribute of the sheet being entered (step S23). It is possible to enter a mixed loading job where sheets of multiple attributes are loaded in a mixture to the printer 100, and therefore, the attribute of the sheet being entered is not always one.

The controller 200 determines whether a job has been entered for the first time for a selected category (step S24). If a job has been entered for the first time (step S24: Yes), the controller 200 sets the feed start timing Tn by the registration roller pair 131 to Tn0 as an initial value (step S25). The following steps S27 to S33 for updating the feed start timing Tn are similar to steps S5 to S11 of FIG. 6, with the feed start timing set to the feed start timing Tn for each category.

If the remaining number of sheets is not zero in step S31 (step S31: No), the controller 200 determines whether the succeeding sheet belongs to the same category as the preceding sheet (step S34). If the succeeding sheet belongs to the same category as the preceding sheet (step S34: Yes), the procedure returns to step S27, and if the succeeding sheet does not belong to the same category as the preceding sheet (step S34: No), the procedure returns to step S24. As described, the feed start timing Tn is updated for each attribute of the sheet P being conveyed.

If the second and subsequent jobs are entered by a category selected in step S24 (step S24: No), the feed start timing Tn is set to Tn_save serving as a save value saved per category (step S26), and the procedure advances to step S27.

As described, according to the present embodiment, update of the feed start timing Tn is performed for each classification of the attributes of the sheet being conveyed. In other words, the feed start timing Tn is set for each of a plurality of categories set based on the attribute of the sheet being conveyed. Therefore, even in a printer where sheets having a wide variety of attributes are conveyed, the toner image can be transferred to an appropriate position on the sheet P while suppressing deviation of the image, so that a product having a high quality can be obtained.

Third Embodiment

Next, a third embodiment of the present invention will be described. The third embodiment adopts a configuration where the feed start timing determination control is different from the second embodiment. Therefore, configurations that are similar to the second embodiment are either not shown in the drawing or denoted with the same reference numbers.

Generally, users tend to use sheets P having the same attribute continuously, and the frequency of use of various categories of the sheets is biased. Meanwhile, the outer diameter of the registration roller pair 131 is reduced by wear with the sheet P, so that the conveyance speed of the sheet P is gradually slowed down. Therefore, in a configuration as in the second embodiment where feed start timing is updated and saved per category, it may be possible that the outer diameter of the registration roller pair 131 is varied from the time when the feed start timing has been saved to when the feed start timing is read. In that case, the image position may be greatly deviated on the first sheet of the job.

Therefore, a feed start timing determination control according to the present embodiment will be described with reference to the flowchart of FIG. 10. The flowchart of FIG. 10 is similar to the flowchart of FIG. 9 except for steps S46, S50 and S52, so that these steps are mainly described, and description of the other steps are omitted.

Figure 10:
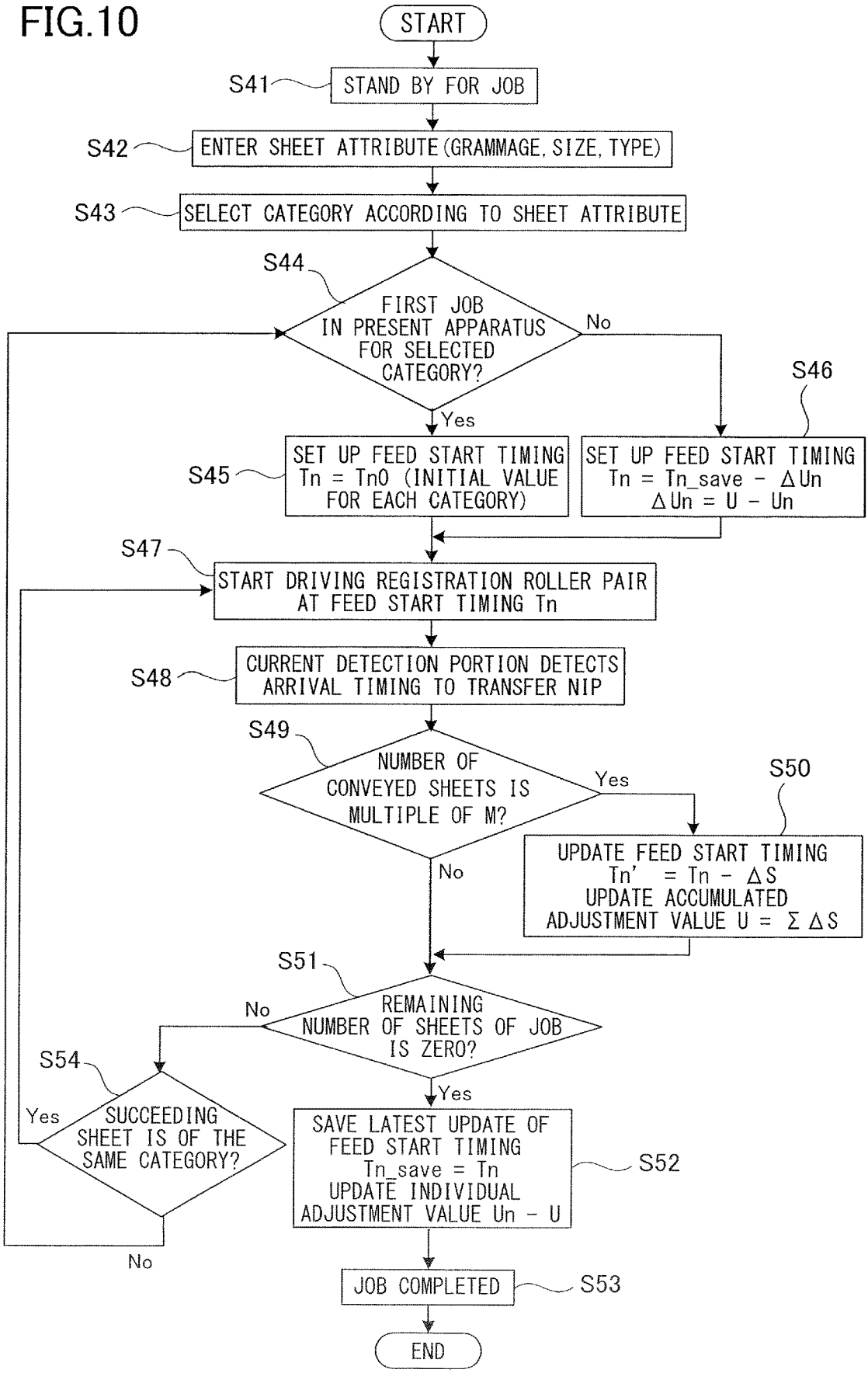
FIG. 10 is a flowchart illustrating a feed start timing determination control according to a third embodiment.

As illustrated in step S50 of FIG. 10, if the feed start timing Tn is to be updated, an accumulated adjustment value U is updated at the same time. The accumulated adjustment value U is a value that is accumulated each time the feed start timing Tn is updated in step S50, and it is represented by $\Sigma\Delta S$. The accumulated adjustment value U is not a value intrinsic to each category, rather, a total sum of adjustment values of all jobs. As illustrated in step S52, in a state where a job is completed, the controller 200 saves the accumulated adjustment value U as an individual adjustment value Un intrinsic to the category.

If a second or subsequent job is entered for the category selected in step S44 (step S44: No), the controller 200 obtains the feed start timing Tn as described below. At first, the controller 200 calculates a difference $\Delta Un = U - Un$ between the individual adjustment value Un of the selected category and the current accumulated adjustment value U. The difference $\Delta U$ is a deviation between the nominal arrival timing due to wear of the registration roller pair 131 and the like during the period in which the category has not been applied. Therefore, the controller 200 sets up the feed start timing Tn as according to the following expression.

$$Tn = Tn_save - \Delta Un$$

As described, according to the present embodiment, the feed start timing Tn of the registration roller pair 131 for the first sheet of the job is adjusted by a difference $\Delta U$ based on the number of sheets that had been conveyed. Therefore, deviation of image caused by degradation over time of the registration roller pair 131 can be suppressed, and the toner image can be transferred to the appropriate position of the sheet P, and a product having a high quality can be obtained.

In all the embodiments described above, the feed start timing of the registration roller pair 131 to the succeeding sheet was adjusted based on the arrival timing of the preceding sheet to the transfer nip N2, but the present invention is not limited to this example. For example, the feeding speed of the registration roller pair 131 can be adjusted based on the arrival timing of the preceding sheet to the transfer nip N2, without changing the feed start timing of the registration roller pair 131.

Further, the image forming timing of the image forming portion 150 and a transfer timing by the transfer nip N2 can be adjusted based on the arrival timing of the preceding sheet to the transfer nip N2, without changing the feed start timing of the registration roller pair 131. Specifically, the timing for writing image to the respective photosensitive drums by the laser scanner 152 serving as the image forming portion can be adjusted. Especially in a monochrome printer rather than a full-color printer, the image forming process can be performed in a short time. Therefore, even if the image forming timing of image to be transferred to the succeeding sheet is changed in response to the arrival timing of the preceding sheet to the transfer nip N2, the change may still be possible to be in time for the transfer timing of the succeeding sheet. Of course, the present invention can be applied to a monochrome printer.

In all the embodiments described above, the toner image on the intermediate transfer belt 155 was transferred to the sheet P by the transfer roller pair 141, but the present invention is not limited thereto. That is, any configuration can be adopted regardless of whether the configuration is a contact type or non-contact type, as long as the configuration applies an opposite bias to toner at the opposite side of the intermediate transfer belt 115 with the sheet P interposed therebetween. Further, the first to third embodiments can be combined freely.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-221695, filed Nov. 27, 2018, which is hereby incorporated by reference herein in its entirety.

What is claimed is:

1. An image forming apparatus comprising:

an image bearing member;

a transfer portion configured to transfer an image borne on the image bearing member to a sheet;

a current detection portion configured to detect a current flowing through the transfer portion;

a conveyance portion configured to convey the sheet to the transfer portion;

a driving portion configured to drive the conveyance portion; and a controller configured to acquire an arrival timing at which a leading edge of a preceding sheet has arrived at the transfer portion based on a detection result of the current detection portion, and control the driving portion in response to the arrival timing in a state where a succeeding sheet that follows the preceding sheet is conveyed by the conveyance portion.

2. The image forming apparatus according to claim 1, wherein the conveyance portion is a roller pair comprising a nip against which a leading edge of a sheet abuts, the conveyance portion configured to convey the sheet at a matched timing with a transfer of image by the transfer portion, and the controller is configured to control the driving portion so that a feed start timing of the succeeding sheet by the roller pair is changed in response to the arrival timing.

3. The image forming apparatus according to claim 2, further comprising a storage portion configured to store the feed start timing that had been changed at an end of a first job, and wherein in a second job that follows the first job, the controller feeds a first sheet of the second job at the feed start timing stored in the storage portion.

4. The image forming apparatus according to claim 2, wherein if the arrival timing of the preceding sheet is a first arrival timing, the controller starts to drive the driving portion at a first drive start timing when conveying the succeeding sheet, and if the arrival timing of the preceding sheet is a second arrival timing that is delayed than the first arrival timing, the controller starts to drive the driving portion at a second drive start timing that is earlier than the first drive start timing when the succeeding sheet is conveyed.

5. The image forming apparatus according to claim 4, wherein if the arrival timing of the preceding sheet is a third arrival timing that is earlier than the first arrival timing, the controller starts to drive the driving portion at a third drive start timing that is delayed than the first drive start timing when the succeeding sheet is conveyed.

6. The image forming apparatus according to claim 2, wherein the controller sets the feed start timing for each of a plurality of categories set based on an attribute of a sheet being conveyed.

7. The image forming apparatus according to claim 1, wherein the controller is configured to control the driving portion based on the arrival timing and a number of sheets having been conveyed.

8. The image forming apparatus according to claim 1, wherein the controller is configured to control the driving portion in response to an average value of arrival timings of a plurality of sheets.

9. An image forming apparatus comprising:

an image bearing member;

an image forming portion configured to form an image on the image bearing member;

a transfer portion configured to transfer an image borne on the image bearing member to a sheet;

a current detection portion configured to detect a current flowing through the transfer portion;

a conveyance portion configured to convey the sheet to the transfer portion; and a controller configured to acquire an arrival timing at which a leading edge of a preceding sheet has arrived at the transfer portion based on a detection result of the current detection portion, and control an image forming timing of the image forming portion to the image bearing member and a transfer timing at which the transfer portion transfers the image to a succeeding sheet in response to the arrival timing when the succeeding sheet that follows the preceding sheet is conveyed by the conveyance portion.

* * * * *